US006234596B1

(12) United States Patent
Egger

(10) Patent No.: US 6,234,596 B1
(45) Date of Patent: May 22, 2001

(54) PANEL FASTENING DEVICE FOR DRAWERS

(75) Inventor: Remo Egger, Bregenz (AT)

(73) Assignee: Grass GmbH, Voralberg (AT)

( * ) Notice: Subject to any disclaimer, the term of this patent is extended or adjusted under 35 U.S.C. 154(b) by 0 days.

(21) Appl. No.: 09/536,086

(22) Filed: Mar. 24, 2000

Related U.S. Application Data

(62) Division of application No. 09/417,649, filed on Oct. 14, 1999.

(30) Foreign Application Priority Data

Oct. 16, 1998 (DE) ..... 298 19 651 U

(51) Int. Cl.[7] ..... A47B 88/00
(52) U.S. Cl. ..... 312/348.4; 312/263; 312/348.2
(58) Field of Search ..... 312/257.1, 263, 312/348.4, 348.1, 348.2; 411/57.1, 34.8, 80.5

(56) References Cited

U.S. PATENT DOCUMENTS

| | | | | |
|---|---|---|---|---|
| 4,690,469 | * | 9/1987 | Grass | 312/263 X |
| 4,850,659 | * | 7/1989 | Rock et al. | 312/263 |
| 4,902,080 | * | 2/1990 | Berger | 312/348.1 |
| 5,002,346 | * | 3/1991 | Gasser | 312/348.4 |
| 5,364,181 | * | 11/1994 | Scheible | 312/348.4 |
| 5,611,637 | * | 3/1997 | Brustle et al. | 312/348.4 X |
| 5,895,103 | * | 4/1999 | Huber | 312/348.4 |

* cited by examiner

*Primary Examiner*—Peter M. Cuomo
*Assistant Examiner*—Michael J. Fisher
(74) *Attorney, Agent, or Firm*—Kilpatrick Stockton

(57) ABSTRACT

A fastening device for fastening a front panel to a metal drawer slide/side is provided which comprises a front panel, a dowel component, and a distance plate, adapted to be connected to a metal drawer slide/side, disposed between the front panel and the dowel component, and an adjustment device comprising an eccentric piece that is operated by a retractable or foldable adjusting lever.

3 Claims, 5 Drawing Sheets

A-A (2 : 1)

B-B (2 : 1)

E-E

X (2 : 1)

PANEL FASTENING DEVICE FOR DRAWERS

This application is a division of application Ser. No. 09/147,649 filed Oct. 14, 1999.

BACKGROUND OF THE INVENTION

The invention is a fastening device that fastens a front panel to ZARGEN drawer slides/sides, according to the characterizing introductory clause of Claim 1.

Modem drawers are built basically in a modular style and consist of several individual components, such as ZARGEN drawer slides/sides, a front panel, a bottom, and a back wall, which can be assembled in varying combinations to complete a drawer. The task is to connect the front panel, especially, to the ZARGEN drawer slides/sides easily and securely. The front panel should be able to be quickly mounted at the site; this enables the utilization of various decorative possibilities, depending on the cabinet/furniture pieces and the front panels.

A front panel fastener, for example, is made known by DE 92 13 683. A snap-in clip is provided that is anchored securely by a second dowel in the front panel. On the ZARGEN side an adjustment component is provided on which the front panel's snap-in clip can be engaged. A secure and quick assembly of the front panel to the drawer ZARGEN slide/side is the result. The disadvantage of this version is the relatively expensive mechanics, which offers a quick and secure mounting of the front panel, but which is costly and expensive to manufacture. Furthermore, a fastening device of this type requires, relatively speaking, a lot of space.

SUMMARY OF THE INVENTION

The present innovation is based on the task of developing a fastening device of the previously mentioned type, which allows a quick assembly of the front panel, requires less space, consists of fewer parts and is more economical to produce.

This task is solved by the characterizing features of Protection Claim 1.

The core of the invention is that a front panel and a dowel component connected to a part of the respective ZARGEN drawer slide/side have one or more expansion dowels that can be guided into the corresponding bore holes of the front panel, and expansion screws that can be guided through openings in the dowel component of the corresponding expansion dowels and can be twisted into the expansion dowel by an operating lever; this results in the spreading of the expansion dowel.

According to a preferred embodiment, the expansion dowel is securely connected to the dowel component. Then, the expansion dowels insert together in the front panel's bore holes. Alternatively, it is naturally possible that the expansion dowels are not connected with the dowel component, but instead are already placed in the front panel's corresponding bore holes before the front panel is mounted.

In order to keep the fastening device small and to give it an ergonomic appearance, an operating lever in the spreading position of the expansion screw (that is, in the position in which the ZARGEN drawer slide/side is securely connected to the front panel) comes to lie in a corresponding notch of the dowel component. The operating levers of the expansion screws are retracted or folded down and are, therefore, close to the dowel component's notch, preventing an operating error or an unintentional twisting of the expansion screw. Preferably the ZARGEN drawer slide/side has a distance plate, which is placed between the front panel and the dowel component, and is connected securely with the front panel by means of the dowel component. The distance plate has elongated holes and/or slotted notches through which the expansion dowels and expansion screws are inserted.

The invention-related fastening device is exceptionally suitable to quickly assemble the front panel to the ZARGEN drawer slide/side, uses minimal space and is simple and economical to produce.

In another embodiment, the fastening device has on the dowel component an adjustment device for the front panel's height modification in relation to the ZARGEN drawer slide/side.

The height adjustment is achieved preferably by means of an eccentric piece, which is operated by a foldable (retractable) adjusting lever.

The distance plate has a guide section, which is guided in a notch of the dowel component. The eccentric piece engages in one of the corresponding slots on the guide section and when the adjusting lever is operated, activates a vertical shifting of the distance plate against the front panel (that is, the dowel component) so that the front panel's position can be adjusted very precisely and exactly in relation to the ZARGEN drawer slide/side.

It is advantageous that the height adjustment of the front panel and the fixing of the fastening device result alone from the respective position of the adjusting lever.

The invention at hand is more closely described by several embodiment examples in reference to several drawing figures in the following. Additional characteristics, features and advantages are found in these drawings and their descriptions. Shown:

A first embodiment of the fastening device is represented in FIGS. 1 through 10.

DETAILED DESCRIPTION OF THE INVENTION

Figure 6:
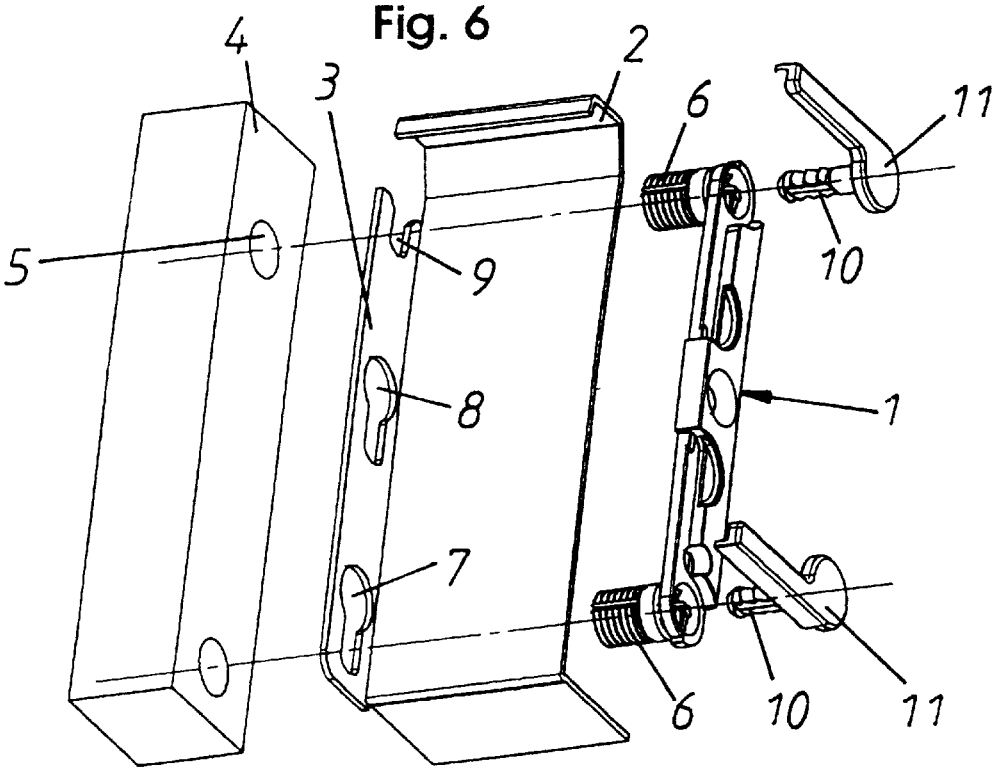
FIG. 6: an exploded representation of the fastening device with ZARGEN drawer slide/side and front panel.

The basic design of the fastening device is best made known in the representation according to FIG. 6. A section of the ZARGEN drawer slide/side (2) is shown here on which a front panel (4), also shown only section-wise, should be fastened. The ZARGEN drawer slide/side (2) has a distance plate (3) for this purpose that comes to lie directly on the front panel (4).

The actual fastening device consists of a long stretched-out dowel component (1) on whose respective end an expansion dowel is located. The expansion dowels are respective bore holes (5) in the front panel (4), so that the bore holes have the same distance from one another as the expansion dowels (6). The dowel component (1), likewise in the area of the expansion dowel, has openings (that is, bore holes) through which expansion screws (10) can be inserted into the expansion dowels. The head component of the expansion screws (10) has an operating lever, which makes the turning of the expansion screws (10) possible without tools.

The distance plate (3) has several elongated holes (7,8), such as slotted notches (9), through which the expansion dowels (6) can be inserted.

Figure 1:
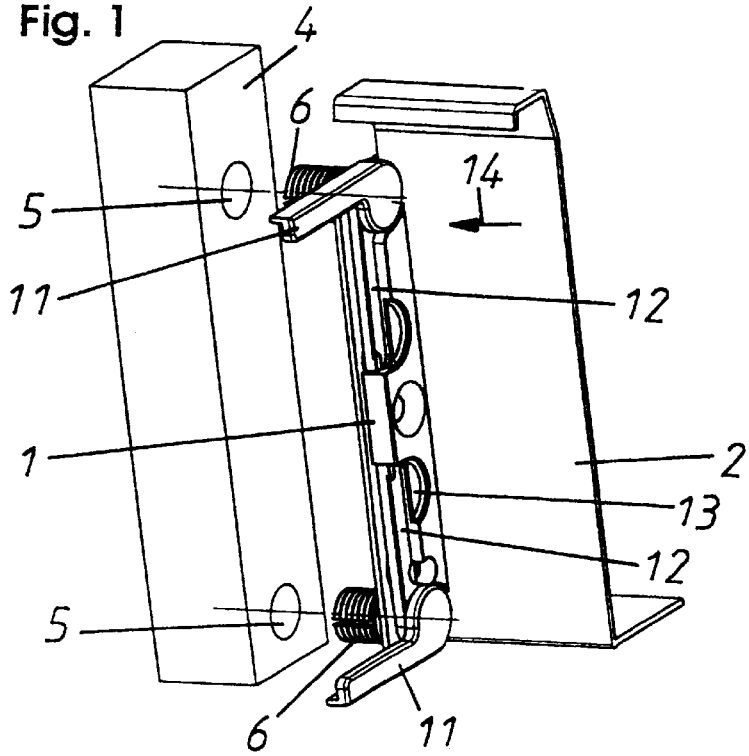
FIG. 1: a perspective view of the fastening device with the ZARGEN drawer slide/side before the front panel is attached.

FIG. 1 shows the dowel component (1) hanged in the distance plate (3) of the ZARGEN drawer slide/side (2) so that the dowel (6) is inserted through the respective elongated holes, such as slotted notches (7–9), of the distance plate (3). The dowel component (1) lies on the distance plate (3). The ZARGEN drawer slide/side (2) with the dowel component (1) can only be placed in the arrow direction (14) on the front panel (4) so that the dowel (6) comes to lie in their respective bore holes (5) in the front panel.

Figure 2:
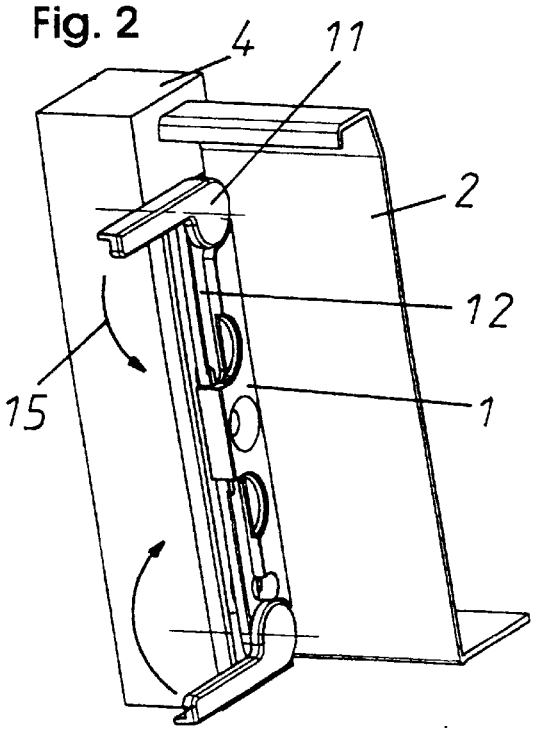
FIG. 2: a perspective view of the fastening device after the front panel is attached.

FIG. 2 shows the dowels already inserted in the front panel's bore holes so that the distance plate (3) of the ZARGEN drawer slide/side (2) lies, on the one hand, on the front panel (4) and, on the other hand, is covered by the dowel component (1). In the position shown here, the operating lever (11) of the expansion screws (10) has not yet activated the spreading of the expansion dowel (6). This occurs first when the operating lever (11) is swiveled around approximately 90° in the arrow direction (15) so that the expansion screws (10) also turn around approximately 90° in the expansion dowels (6). A respective profiling of the expansion screws (10) (as shown for example in FIG. 5) results in this: by turning the expansion screw (10) in the arrow direction (15) by means of an operating lever (11), the expansion dowel spreads (that is, flares outwardly) so that the dowel anchors securely in the corresponding bore hole (5) of the front panel (4). Respectively, the second dowel also anchors in the bore hole (5) of the front panel (4) when the operating lever (11) is turned or twisted.

Figure 3:
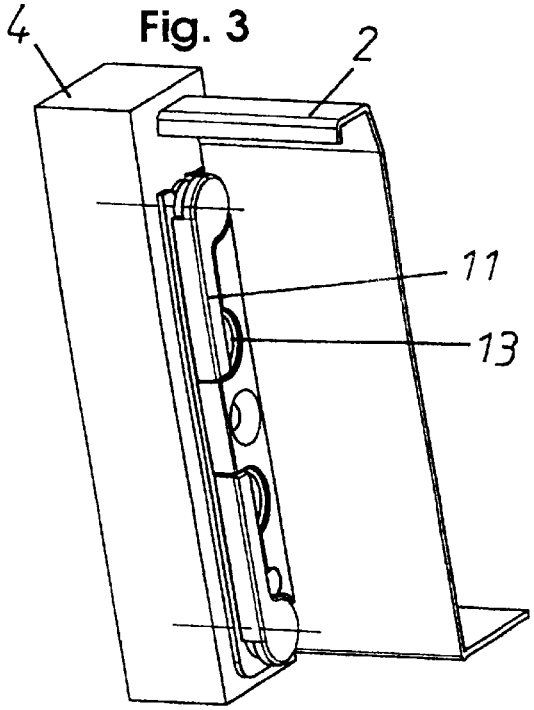
FIG. 3: a perspective view of the fastening device after the expansion dowel spreads with retracted or folded-down operating lever.

FIG. 3 now shows the fastening device in the anchored state (that is, the operating levers [11]) are swiveled in and come to rest in the corresponding notches (12) in the dowel component. The operating lever (11) almost forms a unit with the dowel component (1), resulting in a space-saving and elegant appearance. In this position, according to FIG. 3, the front panel (4) is also securely connected with the ZARGEN drawer slide/side.

Figure 4:
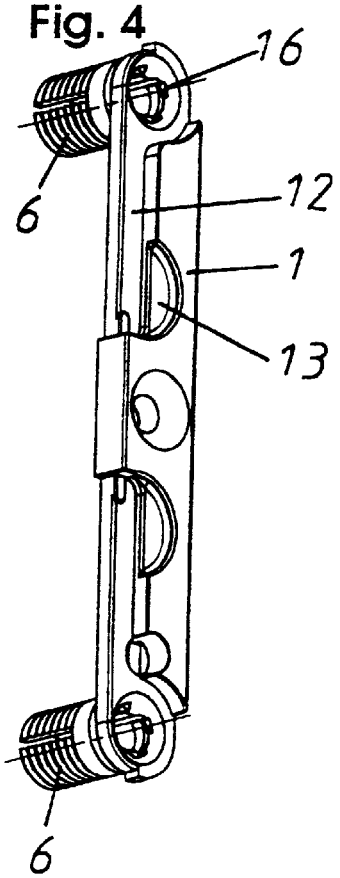
FIG. 4: a perspective view of the dowel component with expansion dowels.
Figure 5:
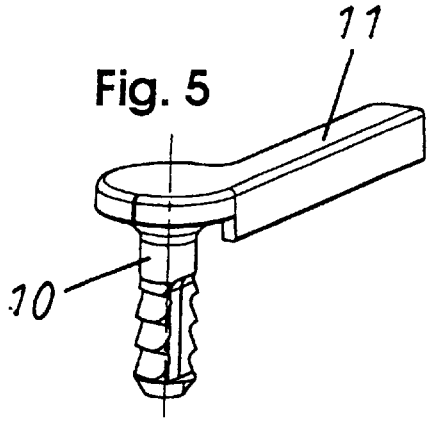
FIG. 5: a perspective view of the expansion screw with the operating lever.

FIG. 4 shows the dowel component (1) individually. One can see the fastened expansion (6) (for example, by means of grips [16]) in the dowel component's bore holes. Furthermore, one recognizes the notches (12) in which the retracted or folded-down operating lever (11) of the expansion screws (10) comes to rest. Additionally, half-moon-shaped recessed grips (13) make it possible to turn the operating levers (11) back out of the notches (12) and to loose the expansion screws.

Figure 7:
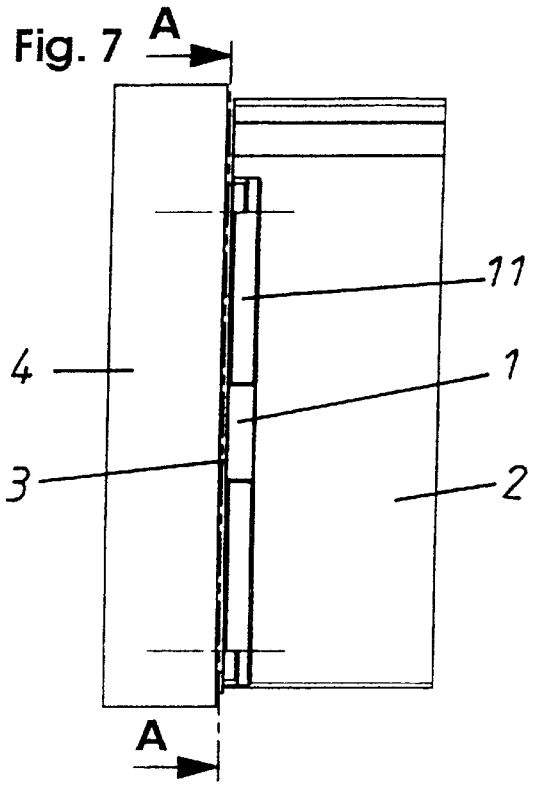
FIG. 7: a side view of the fastening device with ZARGEN drawer slide/side and front panel.
Figure 8:
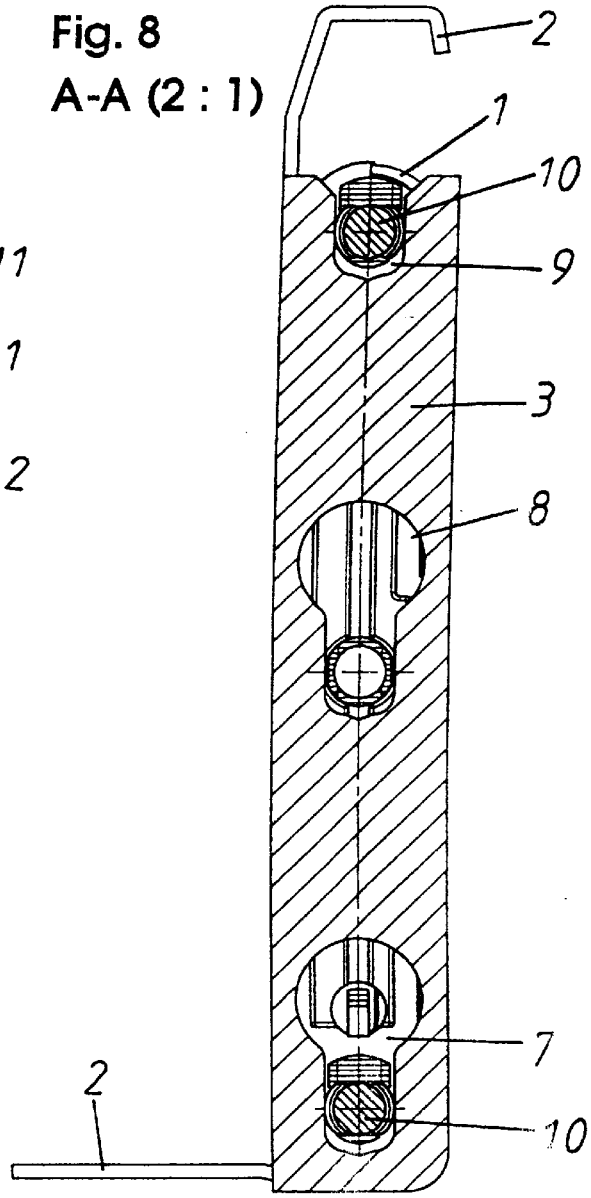
FIG. 8: a section through FIG. 7 along the Line A—A in an enlarged representation.

FIG. 7 shows a side view of the fastening device with the ZARGEN drawer (2) slide/side and the front panel (4), so that FIG. 8 shows a section of the distance plate's (3) area. Here one recognizes that the expansion dowels (that is, the expansion screws [10]), which are located in the dowel component (1) are engaged through the corresponding elongated holes (7,8) (that is, the slotted notches [9]) of the distance plate and are anchored in the front panel's (4) bore holes (5) so that the distance plate (3) of the ZARGEN drawer slide/side (2) is securely connected with the front panel (4).

Figure 9:
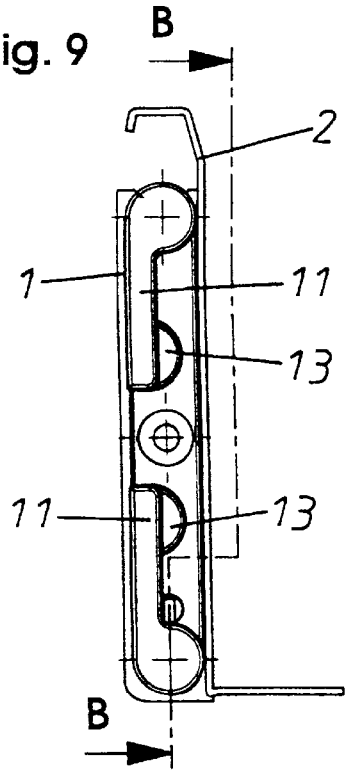
FIG. 9: an overview of the fastening device.

FIG. 9 shows an overview of the fastening device with the operating levers (11) in a locked position; that is, the expansion dowels are spread and the ZARGEN drawer slides/sides (2) are securely connected with the front panel (4).

Figure 10:
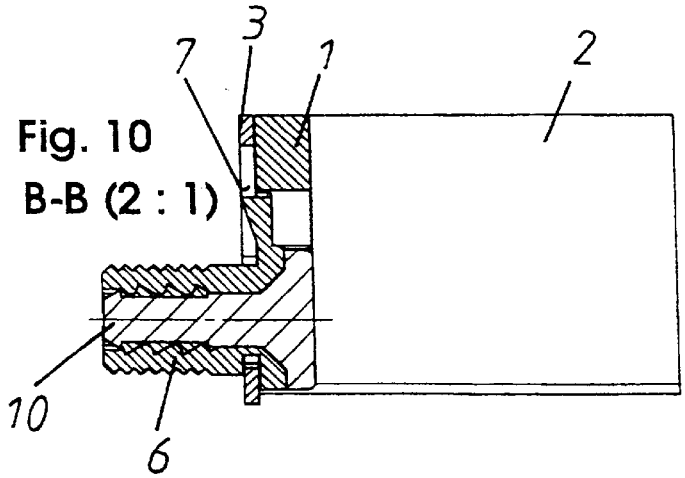
FIG. 10: a section through FIG. 9 along Line B—B in an enlarged representation.

FIG. 10 shows an enlarged section through the dowel component (1). One sees the expansion dowels (6), in which the expansion screws (10) are inserted, securely connected with the dowel component (1). By turning the expansion screws (10), the cross section of the expansion screws change with regard to the dowel bore holes so that the expansion dowel (6) spreads outwardly.

A second embodiment of the fastening device is represented in FIGS. 11–17.

Figure 17:
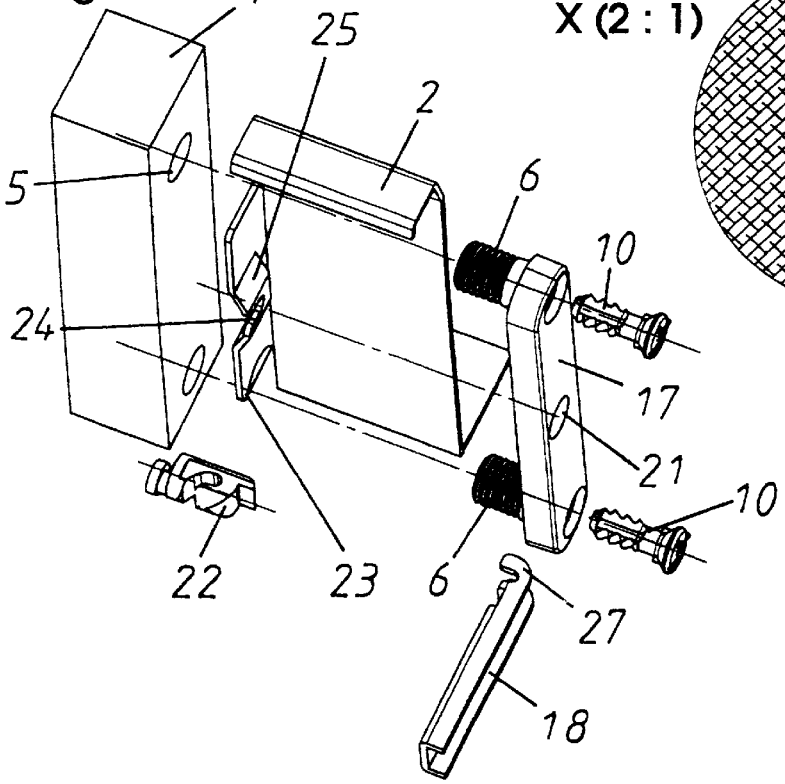
FIG. 17: an exploded representation of the fastening device according to FIGS. 11 through 14.

The design of the fastening device is best seen in FIG. 17. Again, sections of the ZARGEN drawer slides/sides (2) are represented, on which the distance plate (23) closes angled. Furthermore, a front plate (4) is represented that should be connected with the ZARGEN drawer slides/sides by means of a dowel component (17). The dowel component (17) is designed as a long stretched-out element that has on its ends expansion dowels (6), which engage in corresponding bore holes (5) of the front panel (4). Standard expansion screws (10) are used to spread the expansion dowels (6) and can be turned with, for example, a screwdriver. Somewhat in the middle, the dowel component (17) has a bore hole 21) in which an eccentric piece (22) can be inserted, so that the eccentric piece (22) has a retainer for the adjusting lever (18), which is held swiveling or swinging in the retainer. The distance plate (23) has a guide section (25) that has a slot (24) in which an extension of the eccentric piece (22) is placed.

During the assembly, the eccentric piece (22) is then guided through the opening (21) of the dowel component (17) and connected with the adjusting lever (18). Then the dowel component (17) is placed on the distance plate (23) and the eccentric piece's (22) projection is guided in the guide section's (25) slot (24) of the distance plate (23). This connects the dowel component (17) with the ZARGEN drawer slide/side (2). Subsequently, the expansion dowels (6) of the dowel component (17) are inserted in the corresponding bore holes (5) of the front plate (4) and locks when the expansion screws (10) are turned in the bore holes.

Figure 11:
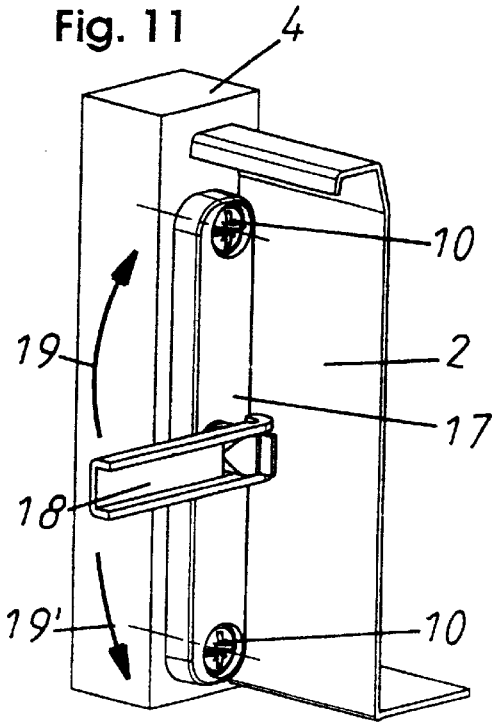
FIG. 11: a perspective view of a second embodiment of the fastening device with an adjustment device.

FIG. 11 shows the front panel (4) fastened to the ZARGEN drawer slide/side (2) so that the front panel (4) is held by the dowel component (17) on the ZARGEN drawer slide/side (2). By turning the adjusting lever (18) in the arrow direction (19 or 19', respectively), only the eccentric piece (22) can be turned inside the bore hole (21) so that the eccentric projection of the eccentric piece (22), which lies in slot (24), can activate a vertical shifting of the distance plate (23). As represented especially in FIGS. 15 and 16, the distance plate (23) is guided by its guide section (25) in a corresponding notch of the dowel component (17) so that this guide simply allows a vertical shifting of components (17, 23) to one another.

Figure 12:
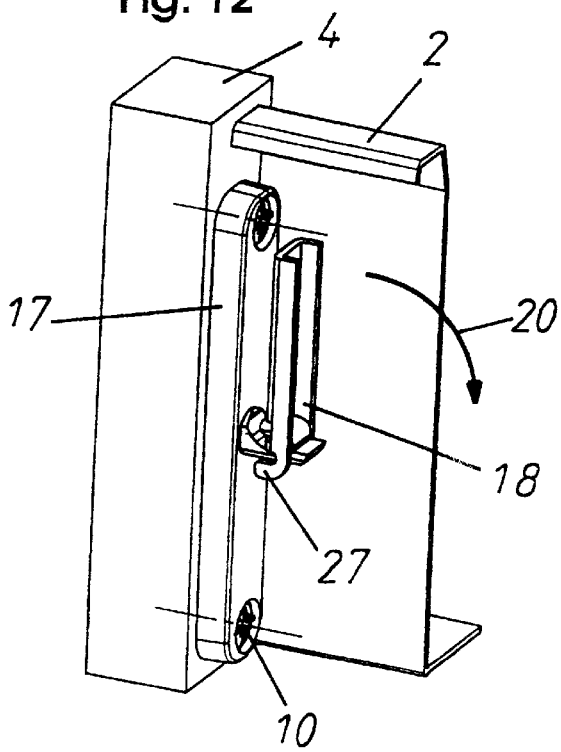
FIG. 12: a view, according to FIG. 11, with a different position of the adjusting lever.
Figure 13:
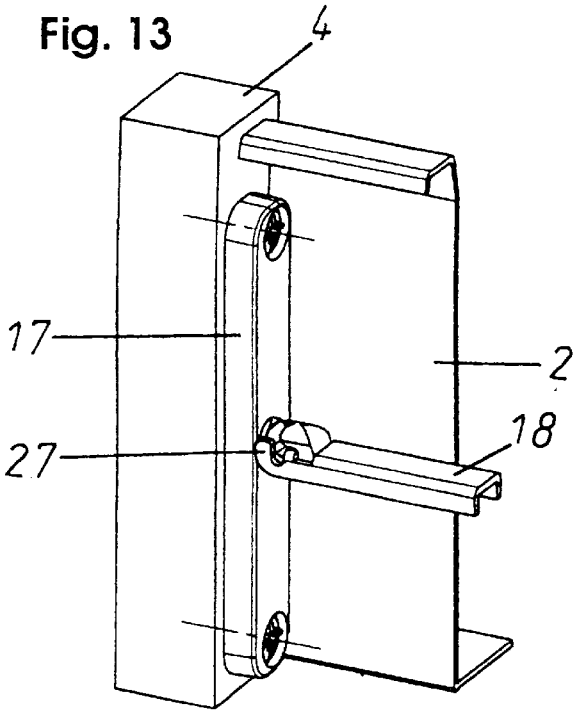
FIG. 13: a view, according to FIGS. 11 and 12, with the adjusting lever in a locked position.

When the desired adjusted position is attained by turning the adjusting lever (18) (as embodied, for example, in FIG. 12), the adjusting lever can only be swiveled approximately 90° in arrow direction (20), which activates a locking of the distance plate (23) in relation to the dowel component (17) as shown in FIG. 13 and is more closely described below.

Figure 14:
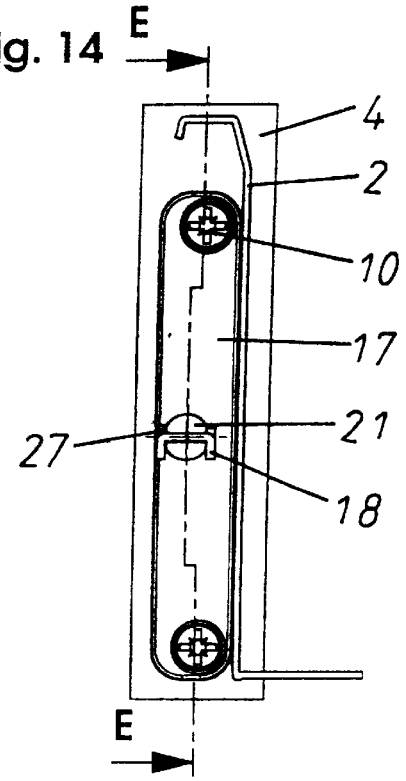
FIG. 14: an overview of the fastening device, according to FIG. 13.
Figure 15:
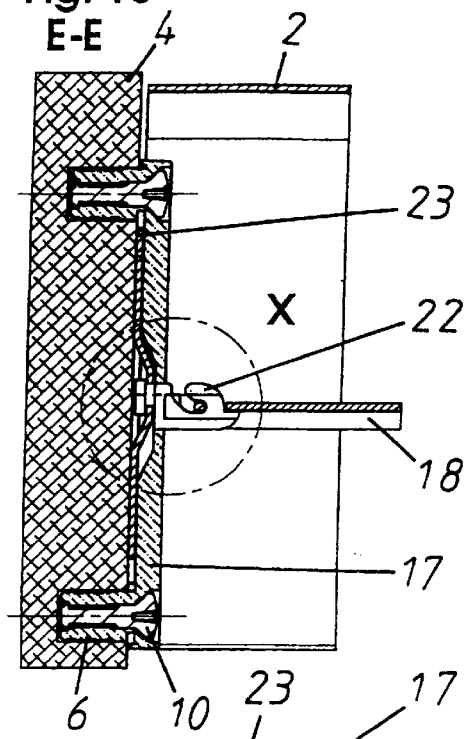
FIG. 15: a section through FIG. 14 along Line E—E.
Figure 16:
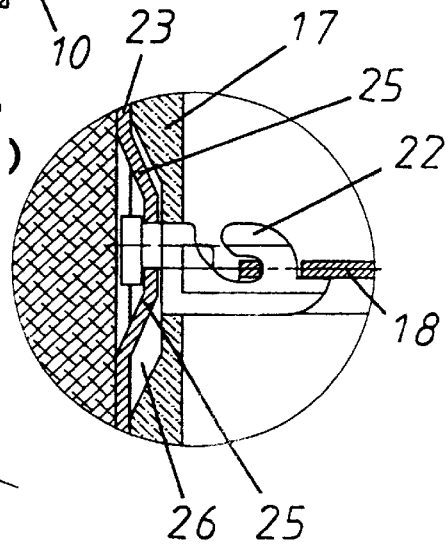
FIG. 16: an enlarged representation of Details X in FIG. 15.

FIG. 14 shows an overview of the fastening device in the adjusting lever's (18) locked position. FIGS. 12 and 13 especially show the bent projections (27) on the adjusting lever (18), which, when in the adjustment position (according to FIG. 12) are not in an operational position.

In the locked position, according to FIG. 13, the projections (27) always press against the dowel component (17) so that a certain pulling force is exerted on the eccentric piece (22), whose pulling force is transferred from the eccentric piece to the distance plate (23). Thus, according to FIGS. 15 and 16, the distance plate (23), respectively, the distance plate's guide section (25), are pressed on the dowel component (17) so that the distance plate (23) and the dowel component (17) can be fixed to one another. So the adjusting lever (18) performs two functions: namely in its position according to FIG. 12, an adjusting function of the distance plate (23) in relation to the dowel component (17) and in its position, according to FIG. 13, a fixing function of the distance plate (23) in relation to the dowel component (17).

DRAWING LEGEND

1. Dowel component
2. ZARGEN* drawer slide/side
3. Distance plate
4. Front panel
5. Bore hole (front)
6. Expansion dowel
7. Elongated hole (distance plate)
8. Elongated hole (distance plate)
9. Slot (distance plate)
10. Expansion screw
11. Operating lever
12. Retainer (for lever)
13. Recessed grip
14. Arrow direction
15. Arrow direction
16. Grips
17. Dowel component
18. Adjusting lever
19. Arrow direction 19'
20. Arrow direction
21. Bore hole
22. Eccentric piece
23. Distance plate
24. Slot
25. Guide section
26. Notch
27. Projection

* ZARGEN is the brand name of an integrated drawer slide system, in which the drawer slide is also the drawer's side.

What is claimed is:

1. A fastening device for fastening a front panel to a metal drawer slide/side comprising a front panel, a dowel component, and a distance plate disposed between the front panel and the dowel component which is adapted to be connected to a part of the respective metal drawer slide/side, and an adjustment device comprising an eccentric piece that is operated by a retractable or foldable adjusting lever; wherein the dowel component is connected to the front panel by expansion dowels adapted to be guided into one or more corresponding bore holes of the front panel wherein expansion screws may be guided through an opening in the corresponding expansion dowel and can be turned, respectively, into the expansion dowel, which then spreads the expansion dowel, and the eccentric piece engages in a corresponding slot of a guide section of the distance plate disposed in a corresponding notch of the dowel component.

2. The fastening device, according to claim 1, wherein the distance plate comprises a guide section disposed in a corresponding notch of the dowel component.

3. Fastening device according to claim 1, wherein the adjusting lever comprises projections on the end of the adjusting lever proximal to the dowel component, which, in the adjusting lever's locked position, contact the dowel component.

* * * * *